US010494924B2

(12) United States Patent
He

(10) Patent No.: US 10,494,924 B2
(45) Date of Patent: Dec. 3, 2019

(54) LONGWALL MINE CONSTRUCTION METHOD N00

(71) Applicant: Manchao He, Beijing (CN)

(72) Inventor: Manchao He, Beijing (CN)

(73) Assignee: Manchao He, Beijing (CN)

( * ) Notice: Subject to any disclaimer, the term of this patent is extended or adjusted under 35 U.S.C. 154(b) by 10 days.

(21) Appl. No.: 15/739,426

(22) PCT Filed: Jun. 24, 2016

(86) PCT No.: PCT/CN2016/086985
§ 371 (c)(1),
(2) Date: Mar. 22, 2018

(87) PCT Pub. No.: WO2016/206618
PCT Pub. Date: Dec. 29, 2016

(65) Prior Publication Data

US 2018/0187547 A1 Jul. 5, 2018

(30) Foreign Application Priority Data

Jun. 24, 2015 (CN) ..... 2015 1 0354564
Oct. 27, 2015 (CN) ..... 2015 1 0707707

(51) Int. Cl.
*E21C 41/18* (2006.01)
*E21D 23/00* (2006.01)
(Continued)

(52) U.S. Cl.
CPC ..... *E21C 41/18* (2013.01); *E21D 23/0034* (2013.01); *E21F 1/006* (2013.01); *E21D 19/02* (2013.01); *E21D 23/0463* (2013.01)

(58) Field of Classification Search
USPC ..... 299/19
See application file for complete search history.

(56) References Cited

U.S. PATENT DOCUMENTS 4,067,618 A 1/1978 Nakajima et al.
4,189,257 A 2/1980 Nakajima et al.
4,378,132 A * 3/1983 Spies ..... E21F 7/00 299/11

FOREIGN PATENT DOCUMENTS

CN 1936271 A 3/2007
CN 200999613 Y 1/2008
(Continued)

OTHER PUBLICATIONS

The CN1OA No. 2017114797446 issued by CNIPA dated Dec. 3, 2018.

(Continued)

*Primary Examiner* — Janine M Kreck
(74) *Attorney, Agent, or Firm* — Yunling Ren

(57) ABSTRACT

A longwall N00 mining method includes performing a no-entry excavation and non-pillar mining in N working faces of a new district, and the whole district is provided with an air-return dip, a haulage dip and a track dip, wherein the air-return dip and the track dip are located on one end of the district, and the haulage dip is connected to the other end of the district, and connected to the air-return dip. This method can not only ensure ventilation of the whole coal cutting are, but also when mining is performed in each working face in the district, entries can be automatically formed due to top-cutting pressure release by using a part of a gob area, and thereby it is not required to separately excavate any gateroad entry during mining coal nor need to retain any coal pillar, so as to save resources and improve efficiency.

6 Claims, 2 Drawing Sheets

(51) Int. Cl.

| | |
|---|---|
| ***E21F 1/00*** | (2006.01) |
| *E21D 19/02* | (2006.01) |
| *E21D 23/04* | (2006.01) |

(56) References Cited

FOREIGN PATENT DOCUMENTS

| | | | |
|---|---|---|---|
| CN | 101289939 | A | 10/2008 |
| CN | 201180544 | Y | 1/2009 |
| CN | 101649741 | A | 2/2010 |
| CN | 201486582 | U | 5/2010 |
| CN | 101725368 | A | 6/2010 |
| CN | 101775991 | A | 7/2010 |
| CN | 102071958 | A | 5/2011 |
| CN | 102080557 | A | 6/2011 |
| CN | 102155219 | A | 8/2011 |
| CN | 102182460 | A | 9/2011 |
| CN | 102287211 | A | 12/2011 |
| CN | 102287212 | A | 12/2011 |
| CN | 102337904 | A | 2/2012 |
| CN | 102392642 | A | 3/2012 |
| CN | 102536239 | A | 7/2012 |
| CN | 102704935 | A | 10/2012 |
| CN | 102877872 | A | 1/2013 |
| CN | 102943683 | A | 2/2013 |
| CN | 102966354 | A | 3/2013 |
| CN | 102996131 | A | 3/2013 |
| CN | 102996150 | A | 3/2013 |
| CN | 103195426 | A | 7/2013 |
| CN | 103266893 | A | 8/2013 |
| CN | 103459772 | A | 12/2013 |
| CN | 103775085 | A | 5/2014 |
| CN | 103775117 | A | 5/2014 |
| CN | 103867224 | A | 6/2014 |
| CN | 103953377 | A | 7/2014 |
| CN | 203717008 | U | 7/2014 |
| CN | 104005779 | A | 8/2014 |
| CN | 104033151 | A | 9/2014 |
| CN | 104179520 | A | 12/2014 |
| CN | 204060781 | U | 12/2014 |
| CN | 104358572 | A | 2/2015 |
| CN | 204646284 | U | 9/2015 |
| CN | 105240013 | A | 1/2016 |
| CN | 105275487 | A | 1/2016 |
| DE | 2344490 | A1 | 3/1975 |
| DE | 3618437 | A1 | 12/1987 |
| DE | 10300387 | A1 | 7/2004 |
| DE | 202005007257 | U1 | 7/2005 |
| DE | 102008050068 | B3 | 1/2010 |
| GB | 2224053 | A | 4/1990 |
| RU | 2287060 | C1 | 11/2006 |
| RU | 2532929 | C1 | 11/2014 |
| WO | 2013102309 | A1 | 7/2013 |

OTHER PUBLICATIONS

The CN1OA No. 2017114831610 issued by CNIPA dated Nov. 26, 2018.

International Search Report issued in the Counterpart PCT Application No. PCT/CN2016/086985 dated Sep. 27, 2016, by the SIPO as the ISA.

The 1st office action issued in the counterpart CN application No. 201510707707.0, dated Feb. 22, 2017 by the SIPO.

Tu, Shi-Hao et al, "The Key Technique on Layout of Entry Entirely in Thick Coal Seam", Journal of China University of Mining & Technology, Mar. 2004, vol. 33, No. 2.

The CN1OA No. 2017114796265 issued by CNIPA dated Dec. 14, 2018.

The CN1OA No. 2016104259762 issued by CNIPA dated Aug. 7, 2017.

The CN1OA No. 201610425964X issued by CNIPA dated Aug. 25, 2017.

The CN1OA No. 2016104291753 issued by CNIPA dated Aug. 18, 2017.

The CN1OA No. 2016104298470 issued by CNIPA dated Aug. 17, 2017.

The CN1OA No. 2016104303341 issued by CNIPA dated Aug. 7, 2017.

The CN1OA No. 2016104304217 issued by CNIPA dated Aug. 8, 2017.

The CN1OA No. 2017114634896 issued by CNIPA dated Nov. 2, 2018.

The ISR No. PCT/CN2016086983 issued by WIPO dated Sep. 27, 2016.

"Technologies of gob-side entry retaining with no-pillar in condition of overlying and thick-hard root" Dec. 2014.

The CN3OA dated Apr. 28, 2019 by the CNIPA.

* cited by examiner

LONGWALL MINE CONSTRUCTION METHOD N00

CROSS-REFERENCE TO RELATED APPLICATIONS

The present application is based on International Application No. PCT/CN2016/086985, filed on Jun. 24, 2016, which is based upon and claims priority to Chinese Patent Application No. 201510354564.X, filed on Jun. 24, 2015, and Chinese Patent Application No. 201510707707.0, filed on Oct. 27, 2015, and the entire contents thereof are incorporated herein by reference.

TECHNICAL FIELD

This disclosure relates to a longwall mining technique in a coal mine, in particular, to a no-entry non-pillar entry self-retaining mining method.

BACKGROUND

At present, in the process of longwall mining, a 121 mining method as shown in FIG. 1, that is, firstly, two entries are excavated in the working face and one coal pillar is reserved for supporting. Specifically, each working face 10 includes an upper gateroad 11, a lower gateroad 12 and a mining face 13. The upper gateroad 11 of the individual working face 10 is connected to a haulage dip 14, and the lower gateroad 12 of the individual working face 10 is connected to an air-return dip 15, in addition, a track dip 16 is also provided. In such structure, the coal pillar needs to be reserved, which causes significant waste of resources. Moreover, it is required to excavate two entries for each working face, and thereby the work efficiency is low.

With development of a large-scale coal mining, amount of coal resources will be reduced day by day, especially in current downturn of the coal industry, the problems, such as high mining cost and low recovery rate of the coal, caused by reserving the coal pillar and excavating entries along the gob area, increasingly arise.

The Background portion contains the contents which are merely used for reinforcing understanding of the background technology of the present disclosure, and thus may include information that does not constitute the prior art as already known by an ordinary person skilled in the art.

SUMMARY

A longwall N00 mining method performs a no-entry excavation and non-pillar mining in N working faces of a new district, and the whole district is provided with an air-return dip, a haulage dip and a track dip, wherein the air-return dip and the track dip are located on one end of the district, and the haulage dip is connected to the other end of the district, and connected to the air-return dip.

In an optional embodiment, a mining process in each of the working faces includes:

- mining from one end of the haulage dip to one end of the air-return dip and the track dip;
- forming a gob area; and
- cutting top for releasing pressure and retaining an entry during mining, wherein a position of a retained entry is a portion close to a next working face, and the retained entry is used as an upper gateroad of the working face.

In an optional embodiment, the haulage dip is changed during mining with one end being always connected to the shaft head via an open-off cut and the retained entry, and the other end being always connected to the air-return dip.

In an optional embodiment, directional roof cutting is used during the gob-side entry retaining process.

In an optional embodiment, anchor rods and anchor cables are used for roof support during the gob-side entry retaining process.

In an optional embodiment, a hydraulic prop support is used near to the entry during the gob-side entry retaining process.

In an optional embodiment, a wood plate is arranged on the hydraulic prop.

BRIEF DESCRIPTION OF THE DRAWINGS

The following detailed description of the present disclosure is taken in conjunction with the accompanying drawings.

DETAILED DESCRIPTION

Typical embodiments embodying features and advantages of the present disclosure will be set forth in the following description. It is appreciated that the present disclosure may have various modifications in various embodiments, all without departing from scope of the invention, and the description and drawings are regarded to be illustrative in nature and not limit the present disclosure.

A longwall N00 mining method is a novel coal mining method with ventilation of the whole district can be ensured without excavating the upper gateroad and the lower gateroad when mining is conducted in the working face longwall, nor need to retain any coal pillar. Hereinafter, the structure of one embodiment will be explained in details. The term "district" as used herein refers to a mining block section that has an independent production system and is divided along a strike within a phase or a mining level. A nearly horizontal coal seam can be also referred as a panel. An inclined longwall strip mining district can also be referred as a strip district.

Figure 1:
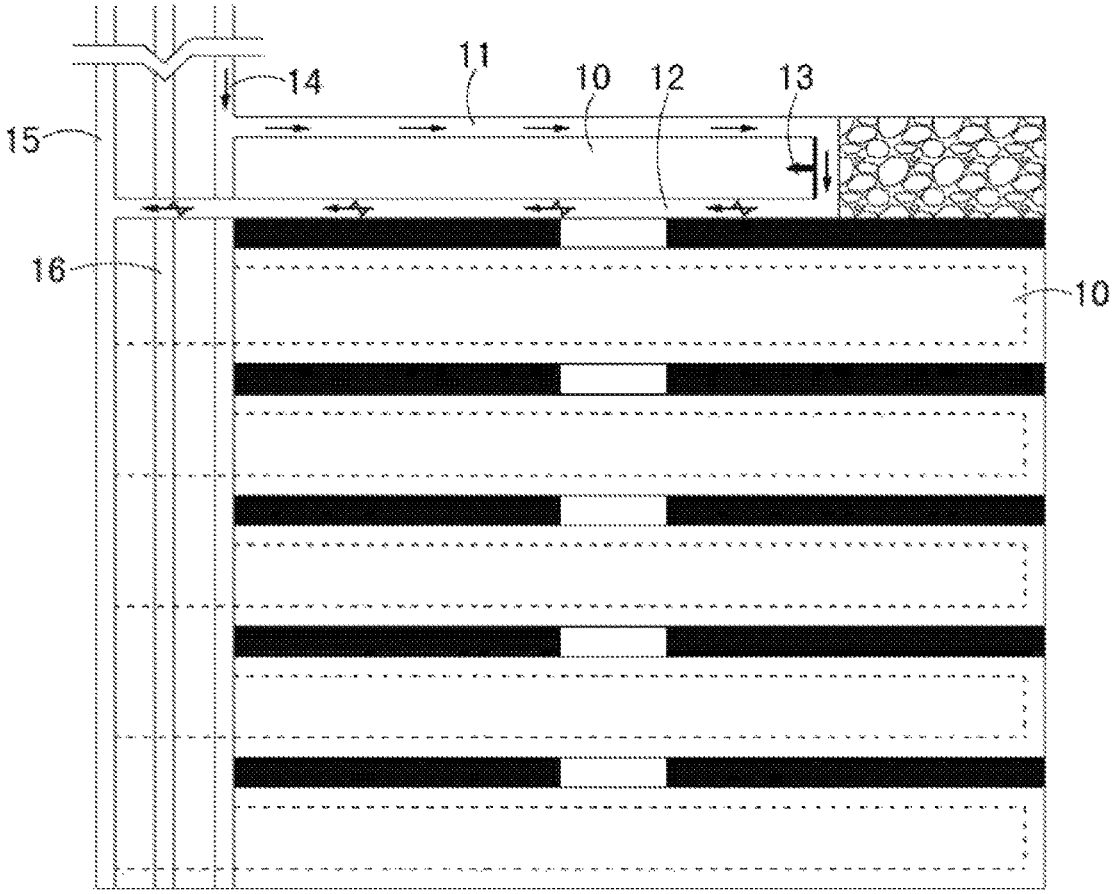
Fig.1 Prior Art
FIG. 1 is a schematic view of a longwall mining method in the prior art.
Figure 2:
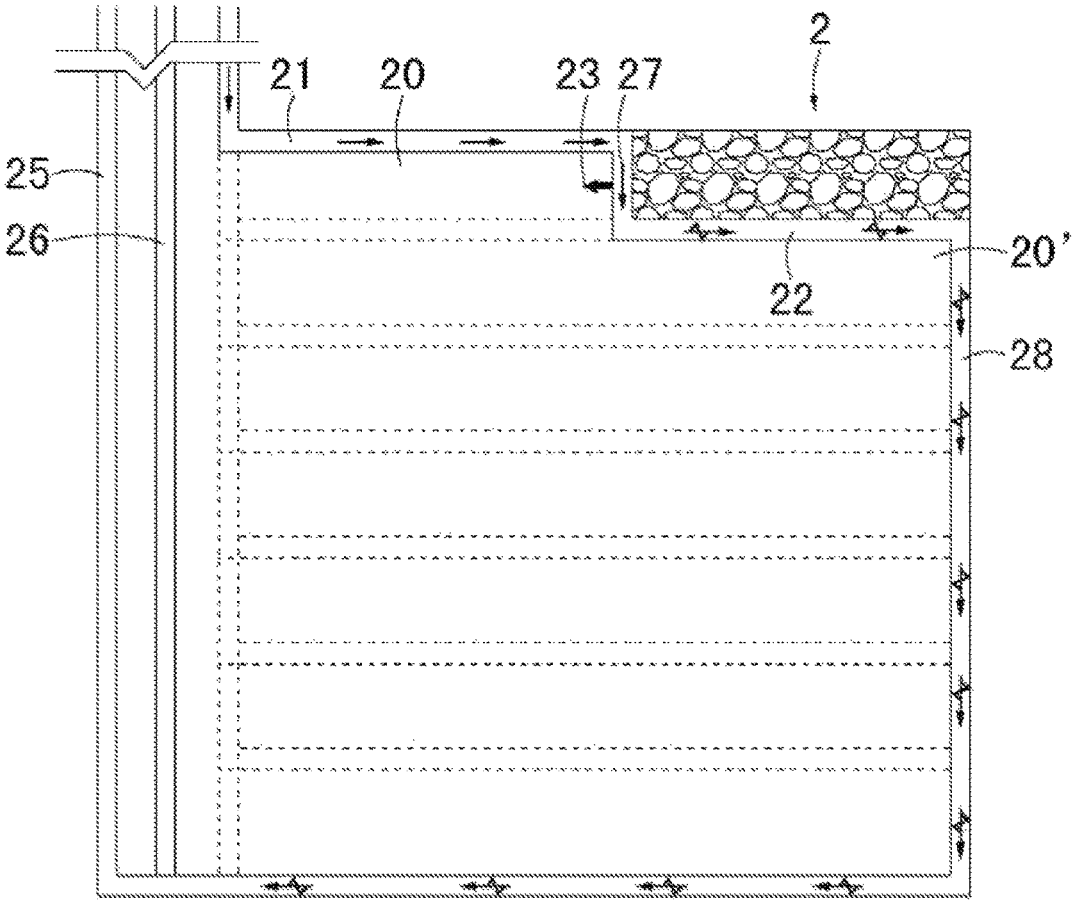
FIG. 2 is a schematic view of a specific application of the longwall N00 mining method according to the present disclosure.

The longwall N00 mining method according to the present disclosure in a specific application as shown in FIG. 2, which illustratively proposes a plane arrangement scheme of a district, mainly includes 2 distinct 2 having an air-return dip 25 and a track dip 26 are directly arranged at one side, and a haulage dip 28 communicated with the shaft head of the district and the other side. The air-return dip 25, the track dip 26 and the haulage dip 28 are connected with the shaft head, and the haulage dip 28 encloses the entire district 2 and then connects with the air-return dip 25 to form an integrate ventilation system of the district 2. The district mentioned herein refers to a mining block section that has an independent production system and is divided along a strike within a phase or a mining level. In the embodiment, the district 2 can be divided into a plurality of working faces according to working requirements. For example, on a first mining face 20, one section of the haulage dip 28 serves as the upper gateroad 21 of the first mining face 20 to perform ventilation (air supply) and convey the coal out.

In the embodiment, the district 2 includes a plurality of working faces 20. On the first mining face 20, one section of the haulage dip 28 is used as an upper gateroad 21 of the first mining face 20. During mining, an entry is retained on a position closed to a next working face 20 to form a lower gateroad 22. In addition, a passage 27 is provided on a mining face 23. In the embodiment, the upper gateroad 21, the passage 27, the lower gateroad 22 and an original haulage dip 28 are connected in turn, that is, the passages of the ventilation system are always connected with each other.

In the embodiment, when mining is performed in a general working face 20, the retained entry on the side of the previous working face is used as the upper gateroad, and the passage 27 of the mining face 23 is used as a ventilation passage, and the self-retained entry is used as a lower gateroad 22, so that a complete ventilation system is still formed.

It is not necessary to excavate the upper gateroad and the lower gateroad in any working face 20 before mining work throughout the above process, only need to continuously retain entry. Accordingly, the work efficiency can be improved and resource consumption can be reduced.

In addition, in the embodiment, retaining entry can be implemented while the top is cut to release pressure. A plurality of cutting drill holes on the same line are constructed on the roof of the working face, after construction of the cutting drill holes by using a cutting drilling machine, the cutting drill holes can be fractured directionally by using a blasting or expanding device to form cracks on the roof. After the coal seam is re-mined, the roof of the pressure release area at the gob is automatically cut off along the crack to form entry ribs of the lower gateroad. Due to crushing expansion of the rock, a stable support of the geological structure of the pressure release area at the gob can be finally achieved. After pressure release by cutting the top, the roof cannot bring any pressure force against the gob area, thereby no coal pillar is retained for support, which can greatly improve the coal mining rate, reduce cost and effectively use energy, so that the market prospect is very good. Also, the passage 27 and the lower gateroad 22 can be supported by arranging supports used for coal mining, to ensure that the two passages cannot collapse as the dynamic changes of the mining work and allow the ventilation passages unobstructed. And, optionally, the lower gateroad 22 may be provided with a lateral support structure to maintain and shape the lateral ribs of the lower gateroad 22.

In the embodiment, each working face 20 during mining includes:

mining in a direction from one end away from the air-return dip 25 and the track dip 26 (i.e., one end close to the haulage dip 28) toward the air-return dip 25 and the track dip 26;

forming a gob area;

cutting top for releasing pressure and retaining an entry during mining, wherein the retained entry position is a side close to the next working face 20.

In this embodiment, the air-return dip 25 and the track dip 26 are unchanged throughout the mining process in order to fix the passages. The haulage dip 28 can be gradually changed along the retained entry during mining in order to adapt for variation of the passages. And the haulage dip 28, after the district 2 is mined out, forms a passage that is substantially parallel to the air-return dip 25 and the track dip 26.

A mining direction of the coal mining system as described in the description refers to overall advancing direction, the coal mining machine in the coal mining system may perform mining towards the left or the right along a front wall in the passage 27, in order to propel to the advancing direction (the direction as indicated by a solid arrow in FIG. 2). The upper gateroad 21 and the lower gateroad 22 are basically parallel to the mining direction of the coal cutting system 7, wherein the "basically parallel" means an unavoidable deviation during mining, and sometimes can be adjusted according to the special situations of coal seams and geology, but being basically in a parallel state. Thereby, the gateroads are formed by continuously retaining entry during the mining work. An area between the rear side of the passage 27 and the outside of the lower gateroad 22 (also referred to as the entry retaining area) may be a pressure release area at a gob, which is a rear gob area created by continuous operation of the coal mining system.

In the embodiment, for top-cutting pressure release and gob-side entry retaining, directional roof cutting and directional blasting are required, and the roof of the entry can be supported by the anchor rods and the anchor cables, and hydraulic props and wood plates are used for comprehensive support, so as to ensure safety. A retained entry is formed after mining coal without being separately excavated, which can save time and reduce waste of resources such as coal, to ensure effective use of the resources.

Advantageous effects of the present disclosure are presented as follows: as compared with the prior art, the present disclosure can not only ensure ventilation of the whole coal cutting are, but also when mining is performed in each working face in the district, entrys can be automatically formed due to top-cutting pressure release by using a part of a gob area, and thereby it is not required to separately excavate any gateroad entry during mining coal nor need to retain any coal pillar, so as to save resources and improve efficiency.

The technical solution of the present disclosure has already described through some exemplary embodiments. It is apparent that those skilled in the art can make modifications and variations to the invention without departing from the scope of the invention. The invention is intended to cover the modifications and variations provided that they fall in the scope of protection defined by the following claims or their equivalents.

What is claimed is:

1. A longwall N00 mining method, wherein in that, a mining is performed in N working faces of a new district, and the whole district is provided with an air-return dip, a haulage dip and a track dip, wherein the air-return dip and the track dip are located on one end of the district, and the haulage dip is connected to the other end of the district, and connected to the air-return dip;

wherein, a mining process in each of the working faces comprises:

mining from the haulage dip to the air-return dip and the track dip;

forming a gob area; and cutting top of the roof of the gob area for releasing pressure and retaining an entry during mining, wherein a position of a retained entry is a portion close to a next working face, and the retained entry is used as an upper gateroad of the working face.

2. The longwall N00 mining method according to claim 1, wherein, the haulage dip is changed during mining with one end being always connected to a shaft head, and the other end being always connected to the air-return dip.

3. The longwall N00 mining method according to claim 2, wherein, directional roof cutting is used during the cutting top of the roof of the gob area for releasing pressure and retaining an entry.

4. The longwall N00 mining method according to claim 3, wherein, anchor rods and anchor cables are used for roof support during the cutting top of the roof of the gob area for releasing pressure and retaining an entry.

5. The longwall N00 mining method according to claim 3, wherein, a hydraulic prop support is used near to the entry during the cutting top of the roof of the gob area for releasing pressure and retaining an entry.

6. The longwall N00 mining method according to claim 5, wherein t, a wood plate is arranged on the hydraulic prop.

* * * * *